United States Patent [19]

Mowbray

[11] 4,132,508

[45] Jan. 2, 1979

[54] FUEL INJECTION PUMPING APPARATUS

[75] Inventor: Dorian F. Mowbray, Burnham, England

[73] Assignee: C.A.V. Limited, Birmingham, England

[21] Appl. No.: 772,746

[22] Filed: Feb. 28, 1977

Related U.S. Application Data

[63] Continuation of Ser. No. 613,805, Sep. 16, 1975, abandoned.

[30] Foreign Application Priority Data

Oct. 1, 1974 [GB] United Kingdom ..... 42508/74

[51] Int. Cl.[2] ..... F04B 29/00; F02M 39/00

[52] U.S. Cl. ..... 417/462; 123/139 AQ

[58] Field of Search ..... 417/462, 218; 123/139 AQ

[56] References Cited

U.S. PATENT DOCUMENTS

| | | | |
|---|---|---|---|
| 2,407,013 | 9/1946 | Fleed | 417/218 |
| 2,877,754 | 3/1959 | Roosa | 123/139 AQ |
| 2,902,017 | 9/1959 | Neap | 123/139 AQ |
| 2,910,975 | 11/1959 | Evans | 123/139 AQ |
| 3,416,505 | 12/1968 | Barber | 417/48 |
| 3,486,492 | 12/1969 | Gehnerer | 123/139 AQ |
| 3,943,902 | 3/1976 | Skinner | 123/139 AQ |

FOREIGN PATENT DOCUMENTS

| | | | |
|---|---|---|---|
| 2603292 | 5/1976 | Fed. Rep. of Germany | 417/462 |

*Primary Examiner*—William L. Freeh

*Attorney, Agent, or Firm*—Holman & Stern

[57] ABSTRACT

A fuel injection pumping apparatus includes an angularly adjustable cam ring having cam lobes which coact with rollers to effect inward movement of a pumping plunger. The cam ring is connected to a piston which due to the reaction of the rollers with the cam lobes, develops a pressure acting on a plunger element. The plunger element is spring loaded and when the pressure exceeds a predetermined value the cam ring will be allowed to move angularly to adjust the injection characteristic of the pump.

3 Claims, 2 Drawing Figures

FUEL INJECTION PUMPING APPARATUS

This is a continuation of application Ser. No. 613,805, filed Sept. 16, 1975 now abandoned.

This invention relates to fuel injection pumping apparatus of the kind intended to supply to an internal combustion engine, and comprising a reciprocable pump plunger, a cam for actuating the plunger, and a pair of members mounting the plunger and cam respectively, one of said members being driven in timed relationship with the associated engine, movement of the plunger in one direction by the cam resulting in displacement of fuel to the engine.

Such an apparatus is very well known for supplying fuel to diesel engines, and in this case, the cam defined on a cam ring mounted within the housing of the apparatus, and the plunger is mounted in a part rotatably driven in synchronism with the associated engine. The profile of the cam determines what is called the injection characteristic, that is to say the variation in fuel pressure over the interval of fuel delivery. It is sometimes required to alter the injection characteristic for a particular engine without altering the profile of the cam, and the object of the present invention is to provide an apparatus of the kind specified which meets this requirement.

According to the invention, in an apparatus of the kind specified the other of said members is allowed limited movement in the direction of movement of said one member, such limited movement of said other member being due to the reaction of the plunger and cam, resilient means being provided to oppose movement of said other member, the arrangement being such that as the reaction force between the plunger and cam increases during the delivery of fuel, said other member will be moved against the action of the resilient means, but will be moved under the action of the resilient means as the reaction force decreases.

One example of a fuel pumping apparatus in accordance with the invention will now be described with reference to the accompanying drawings, in which.

Figure 1:
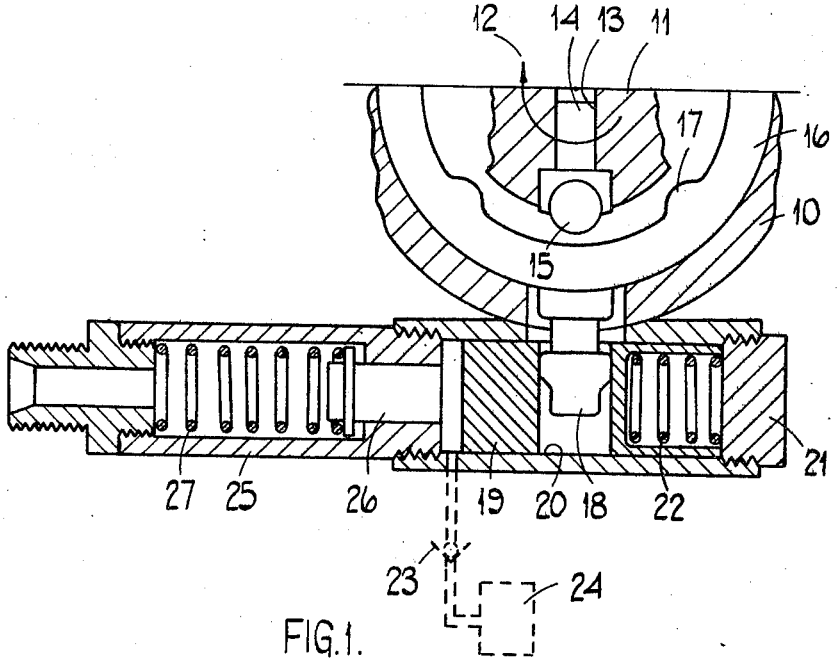
FIG. 1 is a part sectional side elevation of a portion of the apparatus.

Referring to FIG. 1 of the drawings, the apparatus comprises a housing 10 in which is journalled a rotary cylindrical distributor member 11 adapted to be driven in timed relationship with an associated engine, the direction of rotation being indicated by the arrow 12. Formed in the distributor member is a transversely extending bore 13 in which is mounted a pair of reciprocable pumping plungers 14, only one of which is shown. At their outer ends, the plungers engage shoes which carry rollers 15, the rollers engaging with the internal peripheral surface of an annular cam ring 16, which is mounted for limited angular movement within the housing 10. On the internal peripheral surface of the cam ring are formed a plurality of cam lobes 17. The transverse bore 13 communicates with a delivery passage formed in the distributor member, and which is arranged to register in turn with a plurality of outlet ports formed in the housing and which communicate with the injection nozzles of the associated engine. The communication of the delivery passage with an outlet port takes place during the time when the plunger 14 is being moved inwardly by a cam lobe 17. Moreover, also formed in the distributor member and housing is inlet passage means through which a quantity of fuel can be supplied to the transversely extending bore 13 during the filling periods of the apparatus. Whilst the fuel is supplied to the bore 13, the plungers 14 will be moved outwardly.

The cam ring 16 is provided with a radially extending peg 18 which is located within a recess formed in a piston 19 slidable within a cylinder 20 defined in a part secured to the housing 10. One end of the cylinder 20 is closed by a plug 21 which serves as an abutment for a coiled compression spring 22 acting to urge the piston 19 towards the left as seen in FIG. 1. Fluid under pressure can be admitted to the other end of the cylinder by way of a non-return valve 23, and this fluid under pressure is derived from a source 24, the pressure of which can be adjusted so as to effect adjustment of the position of the piston 19, and therefore the cam ring 16. The non-return valve 23 serves to prevent fluid flowing back towards the source 24 when the rollers 15 engage with the cam lobes 17. The apparatus thus far described is well known, and the variation in the pressure of the source 24 results in a variation in the start of injection of fuel to the associated engine. It will be appreciated that leakage of fluid between the wall of the piston 19 and the cylinder 20 is permitted so that the piston 19 can move under the action of the coiled compression spring 22 so as to retard the timing of injection of fuel.

Figure 2:
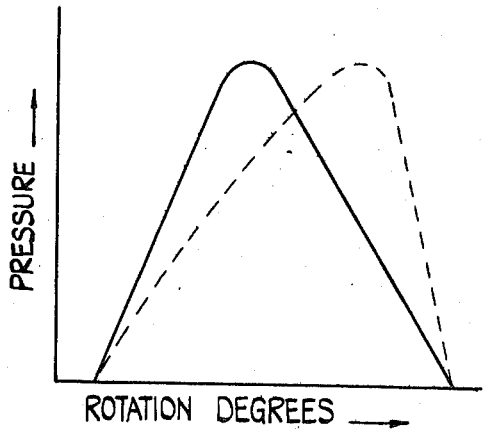
FIG. 2 is a graph showing the injection characteristics.

The solid curve in FIG. 2 shows the injection characteristic which is obtained from the apparatus thus far described. It will be noted that the injection characteristic represents the variation in pressure over the period of delivery of fuel, i.e. inward movement of the plunger. The shape of the injection characteristic depends largely upon the profile of the leading face of the cam lobe. As has been mentioned, it is often desired to alter the injection characteristic, and whilst this could be done by altering the profile of the cam lobe, it is preferable to utilise a standard cam lobe and to alter the injection characteristic in some other way. The dotted curve in FIG. 2 shows the injection characteristic obtained with the apparatus as will be described, and it will be noted that the period of delivery of fuel in terms of degrees of rotation of the distributor member is exactly the same. It will be observed, however, that the peak pressure is achieved later in the interval of delivery.

Turning now to FIG. 1, the end of the cylinder 20 remote from the plug 21, is provided with an attachment 25 which defines a bore communicating with the cylinder 20. The bore mounts a piston element 26, which is loaded in a direction towards the piston 19, by means of resilient means in the form of a coiled compression spring 27. The compression spring 27 is housed within a chamber defined in the attachment 25, the interior of the chamber in use, being at atmospheric pressure.

The piston element 26 is subjected to the pressure within the cylinder 20, and when the rollers 15 engage with the cam lobe 17, the cam ring 16 tends to move in the same direction as the distributor member due to the reaction between the rollers and cam lobes. This movement is transmitted to the piston 19, and results in an increase in the pressure within the cylinder 20. This pressure is applied to the piston element 26, and a force is generated which is opposed by the spring 27. When the preload of the spring 27 is overcome, then the piston element 26 will move towards the left as seen in the drawing, and this will permit movement of the piston 19, and therefore movement of the cam ring 16 in the direction of rotation of the distributor member. The effect of this movement is to limit the rate of rise of pressure, thereby displacing the pressure peak to a point later in the period of delivery. When the pressure starts to fall, the spring 27 moves the piston element 26 and in like manner the piston 19 is moved against the action of the spring 22 so that the rate of fall of pressure is increased.

I claim:

1. A fuel injection pumping apparatus comprising a rotary distributor member defining a bore including a reciprocal pumping plunger, a cam member for effecting reciprocation of said plunger in said bore to provide a pumping action on rotation of said distributor member, means mounting said cam member for limited rotational movement during rotation of said distributor member and means controlling said limited rotational movement of the cam member to control the injection pressure characteristics of the apparatus, said controlling means comprising a first cylinder, a first piston in said first cylinder, connection means between said cam member and said first piston, said connection means urging said first piston towards one end of said first cylinder as a result of a reaction force established between said cam member and said plunger during a pumping stroke of said plunger, a second cylinder having one end communicating with said one end of said first cylinder and having its other end open to atmosphere, said second cylinder including a second piston and resilient means in said second cylinder, said resilient means urging said second piston towards said one end of said first cylinder and resisting movement of said first piston towards said one end of said first cylinder until said reaction force increases sufficiently to overcome the force of said resilient means to effect movement of said first piston and movement of said cam member in the direction of rotation of said distributor member and said first piston and said cam member being moved in reverse direction under the influence of said second piston and said resilient means when said reaction force decreases below the force of said resilient means.

2. The apparatus of claim 1 further including spring means in said first cylinder urging said first piston towards said one end of said first cylinder and means connecting said one end of said first cylinder to a source of pressurized fluid.

3. The apparatus of claim 2 wherein said means connecting said one end of said first cylinder to a source of pressurized fluid includes a non-return valve for preventing flow of fluid from said one end of said first cylinder to said source.

* * * * *